United States Patent [19]

Fischer et al.

[11] 4,043,268

[45] Aug. 23, 1977

[54] CONTAINER CONSTRUCTION FOR AN EJECTABLE BALLISTIC PAYLOAD

[75] Inventors: Siegmar Fischer, Duesseldorf-Kaiserswerth; Dietmar Karius; Güenter Sikorski, both of Duesseldorf, all of Germany

[73] Assignee: Rheinmetall GmbH, Duesseldorf, Germany

[21] Appl. No.: 691,975

[22] Filed: June 2, 1976

[30] Foreign Application Priority Data

June 7, 1975 Germany ..... 2525553

[51] Int. Cl.[2] ..... F42B 13/14

[52] U.S. Cl. ..... 102/66; 102/90

[58] Field of Search ..... 102/6, 65, 66, 90

[56] References Cited

U.S. PATENT DOCUMENTS

| | | | |
|---|---|---|---|
| 1,279,422 | 9/1918 | Peterson | 102/6 |
| 3,713,383 | 1/1973 | Crescenzo et al. | 102/6 |
| 4,002,121 | 1/1977 | Prochnow et al. | 102/66 |

FOREIGN PATENT DOCUMENTS

| | | | |
|---|---|---|---|
| 411,540 | 8/1945 | Italy | 102/66 |
| 259,539 | 7/1926 | United Kingdom | 102/6 |

*Primary Examiner*—Verlin R. Pendegrass

[57] ABSTRACT

A segmented ejectable payload container is arranged to provide improved protection against axial separation of its segments during the firing operation. The container is formed as a hollow shell, with its outer jacket formed integral with a bottom end plate whose outer surface is recessed to receive an outwardly extending flange of an inner container jacket. The other end of the opposed jackets is removably closed by means of a threaded end plate. A second flange on the inner jacket is received in a corresponding recess of the second end plate when such end plate is in operative position. The interfaces between the flanges on the inner jackets and the recesses in the respective end plates are closed by means of a radially disposed seal. The depth of such recesses is chosen so that the outer surface of each end plate projects beyond the adjacent surface of the associated flange.

9 Claims, 3 Drawing Figures

CONTAINER CONSTRUCTION FOR AN EJECTABLE BALLISTIC PAYLOAD

BACKGROUND OF THE INVENTION

The invention relates to ejectable payloads for ballistic projectiles, and more particularly to payloads consisting of hollow annular containers adapted to receive an incendiary charge.

In the copending, co-assigned application Ser. No. 600,965 filed Aug. 1, 1975, and now U.S. Pat. No. 4,002,121 and entitled "INCENDIARY PAYLOAD FOR A HEAVY-DUTY BALLISTIC PROJECTILE", incendiary material is arranged along and coaxially around a central ignition channel extending between a nose portion and a tail portion of the projectile. The incendiary material is disposed, before detonation, within a plurality of hollow annular elongated containers which are successively disposed in abutting relation between the nose portion of the projectile and an end plate situated in the tail of the projectile behind the rear-most container. The individual containers, which are formed from a high-strength alloy of a light metal, are bounded radially by axially extending inner and outer cylindrical jackets, and are bounded longitudinally by a pair of annular end plates.

In order to reinforce such segmented container construction against a tendency to separate in the presence of high tensile loads occurring, e.g., during firing of the projectile, both the inner and outer jackets are reinforced by surrounding shells of substantially U-shape, the bent ends of the shells being received in recesses in the end plates and terminating flush with the outer surfaces of such end plates.

SUMMARY OF THE INVENTION

The present invention involves an improved construction of hollow container of the general type described in such copending application Ser. No. 600,965, the improved construction providing improved resistance against separation of the container segments during the occurrence of high tensile forces.

In an illustrative embodiment, the outer cylindrical jacket of the hollow container is made integral with the lower end plate of the container, such end plate exhibiting a first recess on a radially inner portion of its outer surface. The upper end of the outer jacket is recessed on an outer surface thereof for threadedly receiving a removable upper end plate of the assembly, such end plate exhibiting a recess corresponding to that of the lower end plate.

A pair of radially outwardly extending flanges on the inner cylindrical jacket of the container are tightly received within the recesses of the upper and lower end plates, with a pair of radially disposed sealing members preferably arranged intermediate the opposed surfaces of the flanges and the recesses.

The inner jacket is preferably formed from inner and outer radially abutting portions, with the inner portion fitting snugly between the opposed surfaces of the upper and lower end plates. The outer portion of the inner jacket extends axially beyond the inner portion to carry the flanges.

With such arrangement, shock-type loads transmitted between the abutting end surfaces of successive ones of the payload containers within the projectile may be isolated from the segmented inner boundary of the containers by making the depth of each end plate recess greater than the thickness of the associated flange, so that the flange remains protectively positioned inwardly of the outer surface of the end plate rather than flush with it. In addition to providing environmental protection (e.g., against humidity) for the interior of the container, the sealing members, because of their radial disposition, are arranged transverse to, rather than in alignment with, the high tensile forces generated inside the projectile during detonation. For additional environmental protection, a second seal may be disposed between the threaded portions of the upper end plate and the outer jacket; since such seal is not subjected to tensile forces, an axial disposition thereof is adequate.

BRIEF DESCRIPTION OF THE DRAWING

The invention is further set forth in the following detailed description taken in conjunction with the appended drawing, in which.

DETAILED DESCRIPTION

Figure 1:
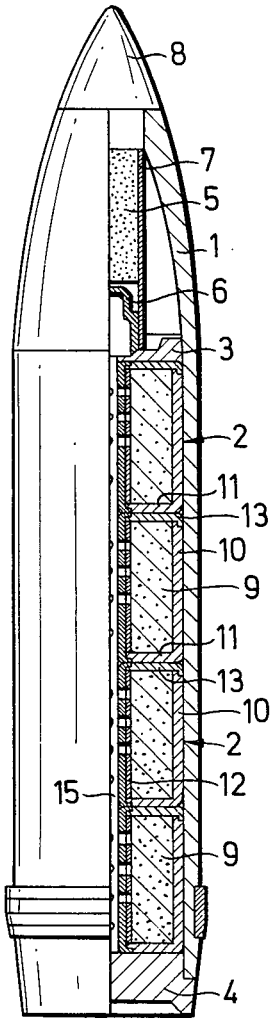
FIG. 1 is a longitudinal view, partially in section, of a projectile containing a plurality of ejectable paylod containers constructed in accordance with the invention.

Referring now to the drawing, the numeral 1 depicts a heavy-duty projectile having a nose portion 8 containing a conventional time fuse and a removable tail portion or floor 3. An explosive charge 5 is disposed near the nose 8, and is contained within a shell 7 which is adapted to disintegrate when the charge 5 is detonated by the fuse in the nose 8.

The projectile 1 is provided with an ejectable-type payload which has as its working element a suitable incendiary composition represented at 9. The composition 9 is disposed in the projectile 1 between a piston 4, which surrounds a hollow spacer 6 in contact with the explosive charge 5 in the nose of the projectile, and the removable floor 3. The composition 9 is arranged around a central elongated channel 15 of the projectile 1 in annular fashion. The channel 15 extends between the spacer 6 and the removable floor 3 of the projectile.

The incendiary composition 9 is confined within a plurality of successively disposed containers 2, 2 which are formed from separable elements of the type described below, such elements in turn being preferably formed from a high-strength light metal alloy.

The containers 2 are compressively arranged in abutting relation between the piston 4 and the removable floor 3 as shown, thereby collectively defining a stable, self-supporting column capable of withstanding high shock loads and velocities upon their ejection from the projectile 1.

Figure 2:
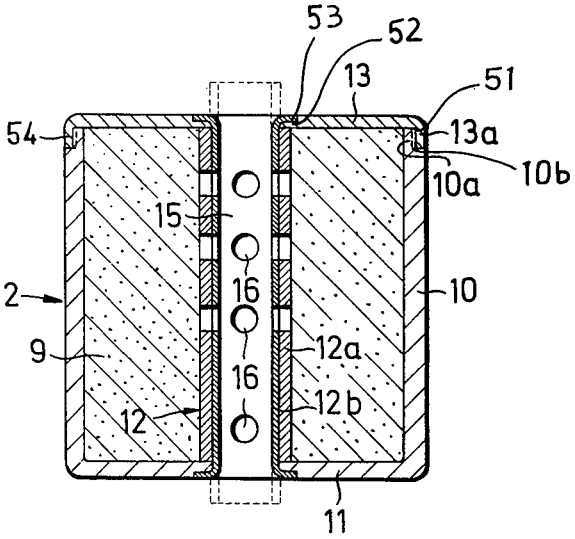
FIG. 2 is a longitudinal section through one of the payload containers of FIG. 1.

A composite inner cylindrical jacket 12 (FIG. 2) of each of the successively disposed containers 2 defines the outer radial boundary of the central ignition chamber 15. The jackets 12 are provided with a plurality of apertures 16, 16 extending radially therethrough as shown for providing communication between the interior of the chamber 15 and the charge 9 within the container 2. The apertures 16 are distributed both circumferentially and longitudinally in the container 2 as shown in FIG. 2.

The arrangement thusfar described in connection with FIGS. 1 and 2 operates as follows:

When the time fuse (not shown) in the nose portion 8 of the projectile 1 has burned for a predetermined time, the explosive charge 5 is detonated and the shell 7 disintegrates. A first portion of the combustion gases generated upon the ignition of the charge 5, after liberation from the shell 7, pushes rearwardly against the piston 4 with sufficient force that the self-supporting column defined by the four successive containers 2 in turn pushes rearwardly against the removable floor 3, so that the latter is pushed out of the projectile 1. Therefore, the successive containers 2 are conditioned for high-speed discharge from the tail of the projectile 1.

A second portion of the hot combustion gases generated by the ignited charge 5 passes through the hollow material of the spacer 6 and enters the ignition channel 15, which, as noted above, is bounded by the successive inner jackets 12 of the containers 2. Such hot gases passing along the channel 15 ignite the incendiary composition 9 in the interior of the containers 2 via the apertures 16.

The containers 2 containing the now-ignited composition 9, upon successive ejection from the tail of the projectile 1, are scattered in a ring-like area of the targeted terrain. Upon impact, the containers 2 remain intact, thereby permitting the composition 9 to likewise remain intact and to burn at a controlled rate for a predetermined time. In this regard, the apertures 16 permit sufficient oxygen from the air to enter the interior of the containers 2 to support the combustion, but not to enter in such quantities as to prematurely burn out the composition.

The firing of the projectile 1, and the detonation of the charge 5 cause the generation of severe impact-type forces in the axial direction of the projectile. Because of the segmented construction of each of the containers 2, a danger therefore exists that the application thereto of such axial forces will tend to separate the segments of the containers from each other, thereby weakening the column-type structure formed by the successively disposed containers and risking loss of the incendiary contents thereof. In addition, the tendency of the containers to separate under such forces would, at a minimum, loosen the interfaces between the segments sufficiently to expose the contents to humidity and other undesired external effects.

In accordance with the invention, each of the containers 2 is constructed in a manner to avoid such disadvantages. In particular, and as shown best in FIGS. 2 and 3, each container 2 is provided with an outer cylindrical jacket 10 extending longitudinally of the projectile axis, such outer jacket being integral with a bottom end plate 11 which extends radially inwardly form a lower end of the jacket.

The outer surface of the bottom end plate 11 is provided with a recess 13b at an inner boundary region thereof for receiving an outwardly directed, bent lower flange 12b of the cylindrical inner jacket 12 of the container 2. A substantially radially disposed sealing ring 14 is interposed between the opposed surfaces of the flange **12*b* and the recess 13*b*** as an aid in insulating the contents of the container from outside moisture.

An open upper end **10*a* of the outer jacket 10 is provided with a recess 10*b* on its outer surface, with the outer surface of such recess exhibiting an external thread 51. The thread 51 cooperates with a mating internal thread on a flange portion 13*a* which extends downwardly as shown from the outer surface of a top cover plate 13, which is arranged to complete the enclosure of the container 2 after the incendiary charge 9** is placed therein.

The inner portion of the radially extending cover plate 13 is provided with a recess 52 in its outer surface, such recess essentially corresponding to the recess **13*b* in the lower end plate 11. An upper flange portion 53 of the inner jacket 12 is bent outwardly as shown to be received within the recess 52 of the cover member 13 after such member has been screwed into the upper portion of the outer jacket 10. If desired, a radially disposed sealing ring 54, corresponding to the ring 14 of FIG. 3, may be interposed between the opposed surfaces of the flange 53 and the recess 52**.

It will be understood that the radial disposition of the sealing members between the flanges **12*b* and 53 and the cover plates 11 and 13 will provide increased resistance against axial detonation forces of the type indicated above. Since such forces will occur only in the vicinity of the inner portions of the container 2, such precautions need not be present regarding the connections between the various segments forming the outer portions of the container. Thus, the essentially axial interface between the threaded recess 10*b* and the threaded, downwardly extending flange 13*a* of the cover plate 13 may, if desired, have an additional sealing member 54 interposed therebetween without sacrificing any of the required protection. The outer diameter of the flange 13*a* is illustratively selected relative to the outer diameter of the jacket 10 so that when the cover plate 13 is screwed into the top part of the jacket 10, the outer surfaces of such members are in substantial axial alignment as shown in FIG. 2**.

Figure 3:
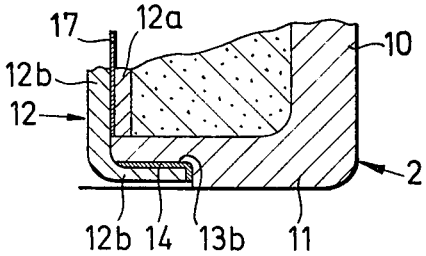
FIG. 3 is a fragmentary, enlarged longitudinal view of a portion of the payload container of FIG. 2.

In order to provide additional protection of the segmented portions of the container 2 against vibration and shocks during the application of axial forces, the thickness of each of the flanges **12*b* and 53 of the inner jacket 12 is made less than the depth of the mating recesses 13*b* on the bottom plate 11 and 52 on the cover plate 13. The result of this is shown in FIG. 3. In particular, it will be noted that the bottom surface of the cover plate 11 projects axially outward beyond the adjacent surface of the flange 12*b*, so that only the relatively thick and stable end portions of the abutting containers 2 in FIG. 1** will be in mutual contact.

The inner jacket 12 of each container 2 is advantageously formed as a composite member including an inner portion **12*b* in abutting relation to an outer portion 12*a*. The portion 12*a*, which may be thicker than the portion 12*b*, is shorter than the portion 12*b* in the axial direction, and is centralized intermediate the flanges 12*b* and 53, which are associated with the inner portion 12*b*. The length of the outer portion 12*a* is selected to correspond substantially to the length of the outer jacket 10 between the upper end thereof and the inner surface of the lower end plate 11, so that such outer portion 12*a* can be snugly received between the opposed end plates 11 and 13 when the latter is screwed into the outer jacket 10. To provide additional protection for the contents of the container 2 against outside moisture, an additional sealing member 17, illustratively in the form of a foil, may be interposed at the interface between the inner portion 12*b* and the outer portion 12*a* of the jacket 12. In addition, the several apertures 16 providing communication between the interior of the ignition channel 15 and the incendiary charge 9 of each container extend in aligned relation through the adjacent portions 12*a*, 12*b* of the jacket 12** as shown.

In the foregoing, an illustrative arrangement of the invention has been described. Many variations and modifications will now occur to those skilled in the art. It is accordingly desired that the scope of the appended claims not be limited to the specific disclosure herein contained.

What is claimed is:

1. In an ejectable payload for a ballistic projectile, the payload comprising incendiary material arranged along and coaxially around a central ignition channel of the projectile and disposed within a plurality of hollow annular elongated containers, the containers being successively disposed axially in abutting relation between a front nose portion and a rear tail portion of the projectile, the inner boundary of each container including at least one apertuer extending radially therethrough for providing communication between the interior of the ignition channel and the incendiary material within the associated container, an improved construction for the container which comprises, in combination, an axially extending outer cylindrical jacket, a first radially disposed end plate integral with and extending inwardly from a lower end of the outer jacket, the inner portion of the first end plate having a first recess in its outer surface, an axially extending inner cylindrical jacket having first and second flanges extending radially outwardly from its upper and lower ends, respectively, a second radially disposed end plate, the inner portion of the second end plate having a second recess in its outer surface, and means for removably and threadedly connecting the second end plate to the upper end of the outer jacket, the first and second flanges of the inner jacket being received tightly within the first and second recesses of the respective end plates when the second end plate and the outer jacket are threadedly connected.

2. The construction as defined in claim 1, in which the connecting means comprises, in combination, means defining a third recess on the outer surface of the outer jacket at the upper end thereof, and a third flange extending downwardly and axially from the outer surface of the second end plate, the outersurface of the third recess and the inner surface of the third flange having mating threads.

3. The construction as defined in claim 2, in which the outer surface of the third flange is disposed in axial alignment with the outer surface of the outer jacket below the third recess when the third flange is threaded into the third recess.

4. The construction as defined in claim 1, in which the inner jacket comprises inner and outer portions disposed in radially abutting relation, in which the first and second flanges extend radially outwardly from the respective ends of the inner portion, and in which the respective ends of the outer portion terminate within and in axially spaced relation to the first and second flanges.

5. The construction as defined in claim 4, in which the length of the outer portion corresponds substantially to the distance between the upper end of the outer jacket and the inner surface of the first end plate integral therewith.

6. The construction as defined in claim 1, further comprising first radially disposed sealing means situated intermediate the inner surface of the first flange and the outer surface of the first recess.

7. The construction as defined in claim 1, further comprising second axially disposed sealing means disposed intermediate the outer surface of the third recess and the inner surface of the third flange.

8. The construction as defined in claim 1, in which the depth of the first recess is greater than the thickness of the first flange so that the outer surface of the first end plate projects axially outwardly from the outer surface of the first flange when the first flange is received in the first recess.

9. A construction as defined in claim 1, in which the depth of the second recess is greater than the thickness of the second flange so that the outer surface of the second end plate projects axially outwardly from the outer surface of the second flange when the second flange is received in the second recess.

* * * * *